US011259562B2

(12) United States Patent
Alvarez De La Cadena et al.

(10) Patent No.: US 11,259,562 B2
(45) **Date of Patent: *Mar. 1, 2022**

(54) SMOKING ARTICLE WITH EXTINGUISHMENT MEANS

(71) Applicant: PHILIP MORRIS PRODUCTS S.A., Neuchatel (CH)

(72) Inventors: Antonio Alvarez De La Cadena, Tigre Buenos Aires (AR); Emeric Grandjean, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 290 days.

This patent is subject to a terminal disclaimer.

(21) Appl. No.: 16/470,739

(22) PCT Filed: Dec. 18, 2017

(86) PCT No.: PCT/EP2017/083396

§ 371 (c)(1),
(2) Date: Jun. 18, 2019

(87) PCT Pub. No.: WO2018/114857

PCT Pub. Date: Jun. 28, 2018

(65) Prior Publication Data

US 2019/0335803 A1 Nov. 7, 2019

(30) Foreign Application Priority Data

Dec. 21, 2016 (EP) ..... 16205908

(51) Int. Cl.

| | |
|---|---|
| ***A24D 1/10*** | (2006.01) |
| ***A24D 1/14*** | (2006.01) |
| ***A24F 1/28*** | (2006.01) |

(52) U.S. Cl.
CPC . *A24D 1/10* (2013.01); *A24F 1/28* (2013.01)

(58) Field of Classification Search
CPC ..... A24D 1/10; A24D 1/047; A24D 3/0225; A24D 3/04; A24D 3/041; A24D 3/061;
(Continued)

(56) References Cited

U.S. PATENT DOCUMENTS

| | | | |
|---|---|---|---|
| 3,065,756 | A | 11/1962 | Noel |
| 3,943,835 | A | 3/1976 | Luke |

(Continued)

FOREIGN PATENT DOCUMENTS

| | | |
|---|---|---|
| CN | 1382402 | 12/2002 |
| CN | 108289514 | 7/2018 |

(Continued)

OTHER PUBLICATIONS

PCT Search Report and Written Opinion for PCT/EP2017/083396 dated Mar. 26, 2018 (9 pages).

(Continued)

*Primary Examiner* — Michael H. Wilson
*Assistant Examiner* — Stephanie Lynn Moore
(74) *Attorney, Agent, or Firm* — Mueting Raasch Group

(57) ABSTRACT

There is provided a smoking article (10) comprising: a tobacco rod (12) comprising a charge (16) of tobacco material circumscribed by a wrapper (18); a filter (14) arranged downstream of the tobacco rod (12); and a hollow tube (20) defining an inner cavity (22) and attaching the filter (14) to the tobacco rod (12). An affixing portion (24) of the tobacco rod (12) is received within the inner cavity (22) and secured to the hollow tube (20) by means of a thermally deactivatable adhesive (26) provided on an outer surface of the wrapper (18) or on an inner surface of the hollow tube (20) or on both. Thus, upon deactivation of the adhesive, at least a portion of the tobacco rod (12) becomes slidable within the hollow tube (20) in relation to the filter (14).

15 Claims, 1 Drawing Sheet

(58) Field of Classification Search
CPC ..... A24D 1/008; A24D 1/02; A24D 1/042; A24D 1/045; A24D 1/22; A24D 3/0266; A24D 3/0275; A24D 3/043; A24D 3/045; A24D 3/048; A24D 3/062; A24D 3/068; A24D 3/08; A24F 1/28; A24F 13/02; A24F 13/16
See application file for complete search history.

(56) References Cited

U.S. PATENT DOCUMENTS

| | | | | |
|---|---|---|---|---|
| 3,977,416 | A | 8/1976 | Akiba | |
| 4,121,597 | A | 10/1978 | Shin | |
| 4,223,597 | A | 9/1980 | Lebet | |
| 4,303,080 | A | 12/1981 | Boegli | |
| 5,709,227 | A | 1/1998 | Arzonico | |
| 5,992,420 | A * | 11/1999 | Moriyama | A24D 1/10 131/187 |
| 9,801,412 | B2 | 10/2017 | Grant | |
| 10,285,434 | B2 | 5/2019 | Park | |
| 10,660,364 | B2 | 5/2020 | Ajithkumar | |
| 2004/0097354 | A1 | 5/2004 | Yamashita | |
| 2011/0108042 | A1 | 5/2011 | Sherwood | |
| 2013/0139836 | A1 | 6/2013 | Blick | |
| 2013/0140197 | A1 | 6/2013 | Fiebelkorn | |
| 2019/0000142 | A1 | 1/2019 | Lavanchy | |
| 2020/0015514 | A1* | 1/2020 | Alvarez De La Cadena | A24D 1/10 |

FOREIGN PATENT DOCUMENTS

| | | |
|---|---|---|
| DE | 90 15 975 U1 | 3/1991 |
| FR | 2 396 519 | 2/1979 |
| GB | 928089 | 6/1963 |
| JP | S45 14075 | 6/1970 |
| JP | 46-16159 | 5/1971 |
| JP | 50-36700 | 4/1975 |
| JP | 50-139797 | 11/1975 |
| JP | 53-69899 | 6/1978 |
| JP | 53-124699 | 10/1978 |
| JP | 9-173042 | 7/1997 |
| JP | 2000-4865 | 1/2000 |
| JP | 2000-325067 | 11/2000 |
| JP | 2013-509889 | 3/2013 |
| JP | 2016-536008 | 11/2016 |
| RU | 2571047 | 12/2015 |
| RU | 2604480 | 12/2016 |
| WO | WO 2002/098246 | 12/2002 |
| WO | WO 2011/121325 | 10/2011 |
| WO | WO 2015/141690 | 9/2015 |
| WO | WO 2015/162730 | 10/2015 |
| WO | WO 2017/115196 | 7/2017 |

OTHER PUBLICATIONS

Office Action issued in China for Application No. 201780074660.6 dated Mar. 22, 2021 (16 pages). English translation included.
Office Action issued in Russia for Application No. 2019119234 dated Mar. 22, 2021 (12 pages). English translation included.
Office Action issued in Japan for Application No. 2019-529543 dated Jan. 4, 2022 (13 pages). English translation included.

* cited by examiner

SMOKING ARTICLE WITH EXTINGUISHMENT MEANS

This application is a U.S. National Stage Application of International Application No. PCT/EP2017/083396 filed Dec. 18, 2017, which was published in English on Jun. 28, 2018, as International Publication No. WO 2018/114857 A1. International Application No. PCT/EP2017/083396 claims priority to European Application No. 16205908.3 filed Dec. 21, 2016.

The present invention relates to a smoking article including a tobacco rod and a filter.

Filter cigarettes typically comprise a rod comprising a charge of smokable material, such as tobacco cut filler, surrounded by a paper wrapper and a cylindrical filter aligned in end-to-end relationship with the wrapped tobacco charge and attached thereto by tipping paper. During smoking, the rod of smokable material is lit at the end furthest from the filter, and smoke from the lit end of the rod is drawn along the rod through the filter to the consumer. As the rod of smokable material is smoked, the burning coal advances towards the mouth end of the rod.

The consumer typically puts out a cigarette when the burning coal is about to reach the filter. This generally requires the use of an ashtray or other suitable surface against which the cigarette is extinguished. This may undesirably leave an unpleasant smell on the consumer's fingers. Besides, it may not always be easy for the consumer to access a suitable surface against which to extinguish the cigarette.

Thus, a need is felt for improving features and functions of filtered smoking articles with a view to facilitating a consumer's experience. In particular, it would be desirable to provide a novel and improved filtered smoking article such that the consumer can easily extinguish the smoking article even without using an ashtray or other suitable surface. In addition, it would be desirable to provide one such filtered smoking article that can easily be manufactured without requiring any major modification to existing equipment.

According to the present invention, there is provided a smoking article comprising: a tobacco rod comprising a charge of tobacco material circumscribed by a wrapper; a filter arranged downstream of the tobacco rod; and a hollow tube defining an inner cavity and attaching the filter to the tobacco rod. An affixing portion of the tobacco rod is received within the inner cavity and secured to the hollow tube by means of a thermally deactivatable adhesive provided on an outer surface of the wrapper or on an inner surface of the hollow tube or on both. Thus, upon deactivation of the adhesive, at least a portion of the tobacco rod becomes slidable within the hollow tube in relation to the filter.

The terms "upstream" and "downstream" are used herein to describe relative positions between elements of the smoking article in relation to the direction of mainstream smoke as it is drawn from a lit end of the smoking article through the filter.

As used herein, the term "longitudinal" is used to describe the direction between the downstream or proximal end and the opposed upstream or distal end and the term "transverse" is used to describe the direction substantially perpendicular to the longitudinal direction.

Within the context of the present invention, the term "deactivatable" is used to describe an adhesive which loses at least a significant portion of its tack or adhesion force (that is, "is deactivated") under predetermined conditions. A "thermally deactivatable adhesive" exhibits a decrease in its adhesion force after being heated to a temperature at or above a "deactivation temperature" of the adhesive.

The "deactivation temperature" of a thermally deactivatable adhesive is the temperature at which the adhesive is deactivated, that is, the temperature at which the adhesion of the adhesive decreases significantly. In embodiments wherein deactivation is achieved over a range of temperatures, the deactivation temperature is the temperature at which the decrease in adhesion begins.

In some embodiments, the deactivation temperature corresponds to the melting point of the adhesive, that is, the temperature at which the adhesive changes state from solid to liquid. Such state of matter change is accompanied by a significant decrease in the adhesion strength of the adhesive and may be optionally associated with an increase in the viscosity of the adhesive. This is typically the case with adhesives comprising crystalline polymers, for which melting is accompanied by discontinuous changes in volume and enthalpy.

In other embodiments, the deactivation temperature corresponds to a glass transition temperature of the adhesive, that is, the temperature at which the adhesive changes from a hard and relatively brittle, glassy state into a viscous, rubbery state. Glass transition is accompanied by a significant decrease in the adhesion strength of the adhesive. This is typically the case with adhesives comprising amorphous polymers, for which the glass transition is accompanied by discontinuous changes in heat capacity and in the thermal expansion coefficient. Without wishing to be bound by theory, this is understood to be related to an alteration of the rigidity of the polymer backbone.

In further embodiments, the deactivation temperature corresponds to a decomposition temperature of the adhesive, that is, the temperature at which the adhesive undergoes a degradation process typically accompanied by weight loss due to loss of moisture or of other groups loosely bonded to the main polymeric backbone, pyrolysis or other reactions.

The term "adhesion force" as used herein refers to the ability of an adhesive to stick to a surface and bond two surfaces together. It is measured by assessing the minimum tensile stress needed to detach or unstick two strips of paper adhered to one another by adhesive provided along a transverse line running across the width of both strips. An increasing traction (dynamic load) is applied on the strips of paper at room temperature and the tensile stress under which the two strips of paper are separated without fibre tear is taken as the "adhesion force".

The same set-up may be used for determining the deactivation temperature. A predetermined load lower than the adhesion force at room temperature is applied to the strips of paper and temperature is increased until the predetermined load becomes sufficient for separated the strips of paper. The temperature at which the strips of paper are separated is taken as the "deactivation temperature".

The term "gas permeability" is used throughout this specification to describe the tendency of a given material to allow permeation, that is, the diffusion of molecules of a gas or of a gaseous mixture (the permeant) through the material. Permeation works through diffusion, therefore the permeant will move under a concentration gradient. Permeability is measured in units of area, commonly in squared metres.

The term "air-impermeable" is used herein to describe a material not allowing the passage of fluids, particularly air and smoke, through interstices or pores in the material. If the hollow tube is formed from a material or materials impermeable to air and smoke, air and smoke drawn into the hollow tube can only flow along the inner cavity and towards the filter.

In a smoking article according to the present invention, the filter is attached to the tobacco rod by means of a hollow tube defining an inner cavity that extends between the filter and the tobacco rod. The tobacco rod comprises a charge of tobacco material, such as for example tobacco cut filler or reconstituted tobacco, circumscribed by a cellulosic wrapper. An affixing portion of the tobacco rod is received within the cavity, and adhesive provided on an outer surface of the wrapper circumscribing the tobacco rod or on an inner surface of the hollow tube or on both secures the tobacco rod to the hollow tube. The adhesive is thermally deactivatable and so, upon deactivation, at least a portion of the tobacco rod becomes free to slide inside the hollow tube and towards the filter end.

The adhesive becomes deactivated when exposed to a temperature above a deactivation temperature. During use this condition can be achieved when the burning coal approaches the affixing portion at the downstream end of the tobacco rod. Accordingly, the consumer puffing on the filter can effectively draw the remaining portion of the tobacco rod—and potentially some ash—into the hollow tube. This causes the extinguishment of the smoking article. Without wishing to be bound by theory, this is understood to be related to the reduced availability of oxygen within the cavity, particularly at a location near the filter.

Thus, it is particularly easy for the consumer to extinguish a smoking article in accordance with the invention without the need for an ashtray or for another surface on which to stub the smoking article. This is advantageously achieved by interacting with the smoking article in a manner that provides a novel and distinctive way of using the smoking article.

In addition, it is less likely for an unpleasant smell to be left on the consumer's fingers, since the need to manually interact with the cigarette stub is significantly reduced. In practice, the consumer can keep holding the cigarette by the filter as during smoking.

Smoking articles according to the invention are easy to manufacture and do not require any extensive modification of the existing apparatus.

In smoking articles according to the invention, a length of the tobacco rod is preferably less than about 40 millimetres. More preferably, a length of the tobacco rod is less than about 30 millimetres. In addition, or as an alternative, a length of the tobacco rod is preferably at least 10 millimetres. More preferably, a length of the tobacco rod is at least about 15 millimetres. In particularly preferred embodiments, a length of the tobacco rod is about 20 millimetres. It has been found that with a tobacco rod having a length less than 40 millimetres it is easy for the consumer to apply on the filter a suction force great enough to draw what is left of the tobacco rod and any ashes into the hollow tube, once the adhesive is deactivated during use. At the same time, it is desirable for the tobacco rod to have a length such as to provide the consumer with a smoking experience as close as possible to that afforded by conventional filter cigarettes, that is, one wherein about six to eight puffs are required for substantially consuming the tobacco rod.

In preferred embodiments, a length of the affixing portion of the tobacco rod is at least about 1 millimetre. In addition, or as an alternative, a length of the affixing portion is preferably less than about 10 millimetres. More preferably, a length of the affixing portion is less than about 8 millimetres. In particularly preferred embodiments, a length of the affixing portion of the tobacco rod is about 5 millimetres.

In some embodiments, the tobacco rod comprises tobacco cut filler. Preferably, a tobacco density of the tobacco cut filler is at least about 200 milligrams/cubic centimetre. More preferably, a tobacco density of the tobacco cut filler is at least about 250 milligrams/cubic centimetre. Even more preferably, a tobacco density of the tobacco cut filler is at least about 300 milligrams/cubic centimetre. In addition or as an alternative, a tobacco density of the tobacco cut filler is preferably less than about 700 milligrams/cubic centimetre. More preferably, a tobacco density of the tobacco cut filler is less than about 600 milligrams/cubic centimetre. Even more preferably, a tobacco density of the tobacco cut filler is less than about 500 milligrams/cubic centimetre. The tobacco density of the tobacco rod may be substantially constant across the whole length of the tobacco rod. In other embodiments, the tobacco density varies along the length of the tobacco rod, the tobacco density at the affixing portion of the tobacco rod being greater than the tobacco density at the upstream end of the tobacco rod.

In other embodiments, the tobacco rod comprises crimped reconstituted tobacco. This is advantageous in that the charge of tobacco in the tobacco rod may substantially be formed from a single piece of reconstituted tobacco, and so a stronger connection can be created between the tobacco rod as a whole and the hollow tube. By way of example, the tobacco rod may be formed from crimped cast leaf.

At least a dot of adhesive is provided at a location along the affixing portion to secure the tobacco rod to the hollow tube. In some embodiments, the thermally deactivatable adhesive is provided over an affixing area of the outer surface of the wrapper or of the inner surface of the hollow tube or of both, the affixing area extending circumferentially about the tobacco rod. In practice a ring of adhesive is provided to secure the tobacco rod to the hollow tube.

Without wishing to be bound by theory, it is understood that when the burning coal approaches the affixing portion of one such smoking article and the adhesive is heated to a temperature equal to or above the deactivation temperature, the structural connection between the tobacco rod and the hollow tube provided by one such adhesive ring is substantially entirely eliminated. This is because the whole ring is heated to substantially the same temperature, and so the force required for drawing what is left of the tobacco rod inside the hollow tube decreases almost instantaneously.

In alternative embodiments, the thermally deactivatable adhesive is provided over the outer surface of the wrapper or of the inner surface of the hollow tube or of both in a pattern spiralling about the tobacco rod over a predetermined length. In practice adhesive is provided about the circumference of the tobacco rod and at different longitudinal locations. Without wishing to be bound by theory, it is understood that when the burning coal approaches the affixing portion of one such smoking article and the adhesive is heated to a temperature equal to or above the deactivation temperature, the structural connection between the tobacco rod and the hollow tube provided by one such adhesive spiral is progressively weakened as the burning coal approaches. This is because portions of the adhesive spiral at a more upstream location reach the deactivation temperature earlier than portions of the adhesive spiral at a more downstream location. Thus, the force required for drawing what is left of the tobacco rod inside the hollow tube decreases smoothly.

Thus, by selecting different adhesive patterns for the affixing portion, it is advantageously possible to fine tune how the force required for effectively extinguishing the smoking article during use.

Preferably, a gas permeability of the hollow tube is less than about 10 CORESTA units. More preferably, the hollow tube is substantially air-impermeable.

In some embodiments, the smoking article comprises a ventilation zone. The ventilation zone may be at a location along the filter or at a location along the hollow tube. During smoking, the consumer should occlude the ventilation openings with his fingers when the time comes for drawing what is left of the tobacco rod into the hollow tube, since the pressure drop caused by the ventilation zone may otherwise impact the consumer's ability to do so.

In order to draw what remains of the smoked tobacco rod into the hollow tube, the consumer applies on the smoked tobacco rod a force that is proportional to the product of the RTD (resistance to draw) of the smoked tobacco rod by the cross sectional area of the smoked tobacco rod. The RTD of the smoked tobacco rod corresponds approximately to the sum of the RTD of the ash, the RTD of the burning coal, and the RTD of the remaining tobacco.

In smoking articles in accordance with the present invention, the RTD of the smoked tobacco rod is preferably at least about 20 millimetres $H_2$ O. More preferably, the RTD of the smoked tobacco rod is preferably at least about 30 millimetres $H_2$ O. Even more preferably, the RTD of the smoked tobacco rod is preferably at least about 40 millimetres $H_2$ O. In addition, or as an alternative, the RTD of the smoked tobacco rod is preferably less than about 200 millimetres $H_2O$. More preferably, the RTD of the smoked tobacco rod is less than about 180 millimetres $H_2O$. Even more preferably, the RTD of the smoked tobacco rod is less than about 160 millimetres $H_2O$. In particularly preferred embodiments, the RTD of the smoked tobacco rod is about 50 millimetres $H_2O$. In embodiments comprising a ventilation zone, the consumer needs to apply on the smoked tobacco rod a force that is proportional to the product of a weighed value of the RTD of the smoked tobacco rod by the cross sectional area of the smoked tobacco rod, wherein the weighed value of the RTD is corrected with respect to a non-ventilated smoking article to take into account the pressure drop induced by the ventilation zone. Without wishing to be bound by theory, it is understood that the higher the ventilation level, the lower the RTD of the smoked tobacco rod.

An adhesive force of the adhesive following deactivation is preferably less than about 0.15 Newtons. More preferably, the adhesive force of the adhesive following deactivation is substantially zero.

Prior to deactivation, the adhesive preferably has a sufficient adhesion to perform the intended function (that is, attach the tobacco rod to the hollow tube). The adhesive force of the thermally deactivatable adhesive prior to deactivation is preferably at least about twice that of the adhesive after deactivation. More preferably, the adhesive force of the thermally deactivatable adhesive prior to deactivation is at least about three times that of the adhesive after deactivation. Even more preferably, the adhesive force of the thermally deactivatable adhesive prior to deactivation is at least about five times that of the adhesive after deactivation, and may be at least about 10 times that of the adhesive after deactivation.

The deactivation temperature may be any temperature that may be experienced when the adhesive is exposed to the burning coal of a smoking article. Preferably, the adhesive has a deactivation temperature of less than about 120 degrees Celsius. Even more preferably, the adhesive has a deactivation temperature of less than about 90 degrees Celsius. In addition, or as an alternative, the adhesive preferably has a deactivation temperature of at least about 70 degrees Celsius.

Suitable thermally deactivatable adhesives may be selected among naturally derived adhesives, such as adhesives derived from waxes, resins, gums or protein compounds. Such naturally occurring adhesives may optionally be modified to promote stable bonding properties. As an alternative, starch, modified starch, carbohydrates and polysaccharides, such as dextrin, may also find use as the thermally deactivatable adhesive of the present invention. Starch and dextrin adhesives, in particular, offer the advantage of high availability and relatively low cost coupled with good adhesion properties and biodegradability. As one further alternative, suitable thermally deactivatable adhesives for use in the present invention may be selected among synthetic adhesives, including one- and two-part adhesives as well as anaerobic and moisture-cure adhesives.

In some embodiments, the deactivation temperature corresponds to the melting point of the adhesive, that is, the temperature at which the adhesive changes state from solid to liquid. Examples of suitable adhesives for which the deactivation temperature corresponds to the melting point of the adhesive include, but are not limited to, gelatin, agar-agar, sacharose, microcrystalline waxes, guar gum.

In other embodiments, the deactivation temperature corresponds to a glass transition temperature of the adhesive, that is, the temperature at which the adhesive changes from a hard and relatively brittle, glassy state into a viscous, rubbery state. Examples of suitable adhesives for which the deactivation temperature corresponds to a glass transition temperature of the adhesive include, but are not limited to, starch, invert sugar, polyvinyl alcohol (PVOH), polylactic acid, carrageenan.

In further embodiments, the deactivation temperature corresponds to a decomposition temperature of the adhesive, that is, the temperature at which the adhesive undergoes a degradation process typically accompanied by weight loss due to loss of moisture or of other groups loosely bonded to the main polymeric backbone, pyrolysis or other reactions.

Other examples of suitable adhesives include, but are not limited to, dextrin, alginate, gum Arabic, natural resins such as Chios mastic, rosin esters.

The elapsed time required for deactivation of the deactivatable adhesive may also impact the performance of a smoking article in accordance with the present invention. The deactivation should be rapid enough to prevent the need for the application of excessive removal force by the consumer. Typically, the elapsed time required for deactivation should be less than 10 seconds, preferably less than about 5 seconds, even more preferably less than about 1 second.

The invention will now be further described, by way of example only, with reference to the accompanying drawings in which.

Figure 1:
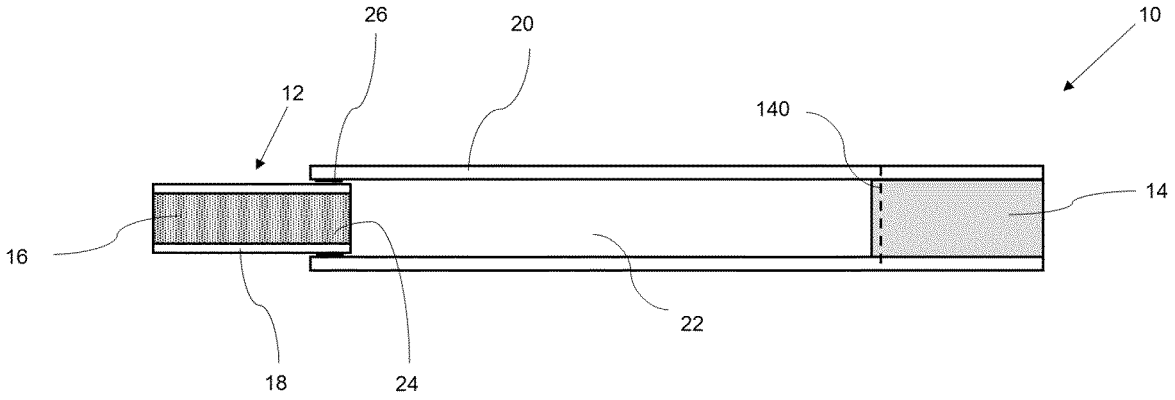
FIG. 1 is a schematic side view of a smoking article in accordance with the present invention prior to smoking.

FIG. 1 shows a smoking article 10 in accordance with the present invention. The smoking article 10 comprises a tobacco rod 12 and filter 14 arranged downstream of the tobacco rod 12. A ventilation zone 140 is provided at a location along the filter 14.

The tobacco rod 12 comprises a charge 16 of tobacco cut filler circumscribed by a wrapper 18. Further, the smoking article comprises a hollow tube 20 attaching the filter 14 to the tobacco rod 12. Thus an inner cavity 22 is defined between the tobacco rod 12 and the filter 14.

In more detail, an affixing portion 24 of the tobacco rod 12 is received within the inner cavity 22 and secured to the hollow tube 20 by means of a thermally deactivatable adhesive 26 provided on an outer surface of the wrapper 18 at the downstream end of the tobacco rod 12. In the embodiment of FIG. 1, the adhesive is provided over an affixing area of the outer surface of the wrapper 18 extending circumferentially about the charge 16 of tobacco material to ensure a strong connection between the tobacco rod 12 and the hollow tube 20. The adhesive has a deactivation temperature of about 70 degrees Celsius.

Figure 2:
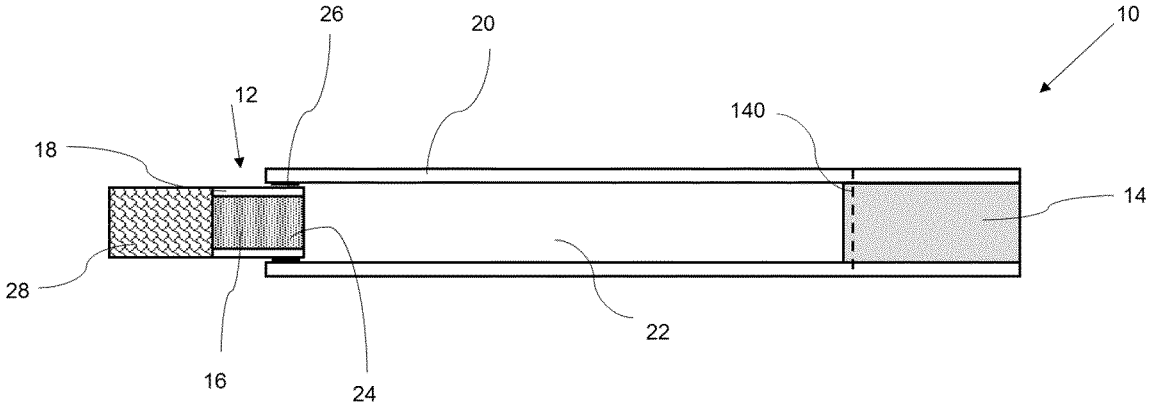
FIG. 2 is a schematic side view of the smoking article of FIG. 1 immediately prior to extinguishment.
Figure 3:
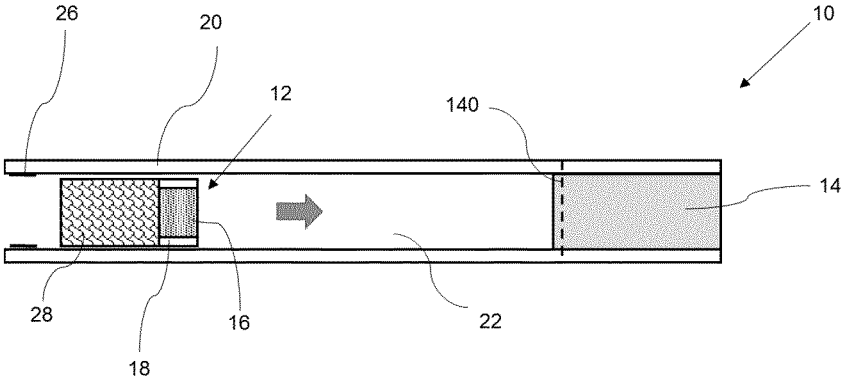
FIG. 3 is a schematic side view of the smoking article of FIGS. 1 and 2 after extinguishment.

During use, as the burning coal approaches the hollow tube 18 and ashes 28 are produced (see FIG. 2), the temperature at the downstream end of the tobacco rod 12 increases. When the temperature at the affixing portion 24 reaches the deactivation temperature of the adhesive, the adhesive is deactivated and there is no longer a structural connection between what is left of the tobacco rod 12 and the hollow tube 20. Thus, what is left of the tobacco rod 12 becomes slidable within the hollow tube 20 in relation to the filter 14. When the consumer next puffs on the filter 14, what is left of the tobacco rod 12 (see FIG. 3) is therefore drawn into the hollow tube along with any ashes 28, as indicated by the arrow. This advantageously causes the smoking article to extinguish without the consumer needing to use an ash-tray.

The invention claimed is:

1. A smoking article comprising:

a tobacco rod comprising a charge of tobacco material circumscribed by a wrapper;

a filter arranged downstream of the tobacco rod;

a hollow tube defining an inner cavity and attaching the filter to the tobacco rod;

wherein an affixing portion of the tobacco rod is received within the inner cavity and secured to the hollow tube by means of a thermally deactivatable adhesive provided on an outer surface of the wrapper or on an inner surface of the hollow tube or on both such that, upon deactivation of the adhesive, at least a portion of the tobacco rod becomes slidable within the hollow tube in relation to the filter.

2. The smoking article according to claim 1, wherein a length of the tobacco rod is less than about 40 millimetres.

3. The smoking article according to claim 1, wherein a length of the tobacco rod is at least about 10 millimetres.

4. The smoking article according to claim 1, wherein the length of the affixing portion of the tobacco rod is at least about 1 millimetre.

5. The smoking article according to claim 1, wherein the length of the affixing portion of the tobacco rod is less than about 10 millimetres.

6. The smoking article according to claim 1, wherein the tobacco rod comprises tobacco cut filler.

7. The smoking article according to claim 1, wherein the tobacco rod comprises crimped reconstituted tobacco.

8. The smoking article according to claim 1, wherein the thermally deactivatable adhesive is provided over an affixing area of the outer surface of the wrapper or of the inner surface of the hollow tube or of both, the affixing area extending circumferentially about the tobacco rod.

9. The smoking article according to claim 1, wherein the thermally deactivatable adhesive is provided over the outer surface of the wrapper or of the inner surface of the hollow tube or of both in a pattern spiralling about the tobacco rod.

10. The smoking article according to claim 1 comprising a ventilation zone at a location along the filter.

11. The smoking article according to claim 1 comprising a ventilation zone at a location along the hollow tube.

12. The smoking article according to claim 1, wherein an adhesive force of the adhesive following deactivation is less than about 0.15 Newtons.

13. The smoking article according to claim 1, wherein an adhesive force of the adhesive prior to deactivation is at least about twice the adhesive force of the adhesive following deactivation.

14. The smoking article according to claim 1, wherein the adhesive has a deactivation temperature of less than about 120 degrees Celsius.

15. The smoking article according to claim 1, wherein the adhesive has a deactivation temperature of less than about 90 degrees Celsius.

* * * * *